United States Patent [19]

Hosono et al.

[11] Patent Number: 5,045,420

[45] Date of Patent: Sep. 3, 1991

[54] COLOR IMAGE FORMING METHOD AND PARTICULATE DEVELOPER FOR DEVELOPING ELECTROSTATIC LATENT IMAGE

[75] Inventors: Nagao Hosono, Hachiohji; Shinkichi Takahashi, Yokohama; Hatsuo Tajima, Matsudo, all of Japan

[73] Assignee: Canon Kabushiki Kaisha, Tokyo, Japan

[21] Appl. No.: 447,070

[22] Filed: Dec. 7, 1989

[30] Foreign Application Priority Data

Dec. 9, 1988 [JP] Japan ..... 63-311463

[51] Int. Cl.[5] ..... G03G 13/01; G03G 9/16

[52] U.S. Cl. ..... 430/45; 430/46; 430/106; 430/394; 355/326

[58] Field of Search ..... 430/45, 37, 394, 106, 430/46

[56] References Cited

U.S. PATENT DOCUMENTS 4,250,239 2/1981 Sakai ..... 430/57 X 4,725,527 2/1988 Robillard ..... 430/339

*Primary Examiner*—David Welsh

*Attorney, Agent, or Firm*—Fitzpatrick, Cella, Harper & Scinto

[57] ABSTRACT

A color image forming method, comprising the steps of: providing a particulate developer comprising at least two species of sensitive particles which are capable of respectively absorbing lights having different wavelengths to be decolorized or faded; developing an electrostatic latent image with the particulate developer to form an image comprising the developer; and exposing the developer image to light having a wavelength capable of selectively decolorizing at least one species of the sensitive particles.

12 Claims, 2 Drawing Sheets

COLOR IMAGE FORMING METHOD AND PARTICULATE DEVELOPER FOR DEVELOPING ELECTROSTATIC LATENT IMAGE

FIELD OF THE INVENTION AND RELATED ART

The present invention relates to a color image recording method utilizing an image forming method such as electrophotography and electrostatic recording, particularly to a color image forming method wherein an electrostatic latent image is developed with developer particles to provide a developed or visualized image and the resultant developed image is then exposed to light to provide a color image, and a developer comprising developer particles to be used for such a color image forming method.

In the conventional color image recording method utilizing electrophotography or electrostatic recording, it has been necessary to use plural species of developers of which number corresponds to the number of requisite colors and plural species of developing devices corresponding to such a number. For example, in a multi-color recording method, it is necessary to use plural species of developers or developing devices of which number is equal to that of the requisite colors. Further, in a pictorial color image recording method, it is necessary to use plural species of developers or developing devices corresponding to three or four colors of C (cyan), M (magenta) and Y (yellow), or C, M, Y and BK (black). Further, it is necessary to repeat a process including the steps of forming a latent image, developing the latent image and transferring the developed image to a transfer-receiving medium plural times corresponding to the number of the requisite colors in the multi-color recording; or three or four times in the pictorial color recording (hereinafter, such a recording method is referred to as "multiple-transfer recording method").

On the other hand, in the recording method disclosed in Japanese Laid-Open patent application (KOKAI) No. 139374/1988, U.S. Pat. No. 4,654,282, etc., it is necessary to repeat a process including a latent image-forming step and a developing step plural times corresponding to the number of requisite colors in the multi-color recording method; or three or four times in the pictorial color recording method, and further to transfer the developed image to a transfer-receiving medium, if any (hereinafter, such a recording method is referred to as multiple-development recording method).

Therefore, in the prior art, the developed visible image is liable to be disturbed by the plural transfer operations in the multiple-transfer recording method, or by the latent image formation after the developing operation in the multiple-development recording method. Further, it has been necessary to dispose a large number of developing devices in the recording apparatus used in such a recording method, and the space occupied by these developing devices becomes larger. As a result, the recording apparatus per se is liable to be larger, and is difficult to be miniaturized.

U.S. Pat. No. 4,725,527 proposes a color image forming method wherein a selected, portion of a recording layer containing plural species of sensitive particles which are capable of respectively absorbing lights having different wavelengths to be decolorized or bleached is exposed to light having a selected wavelength to selectively decolorize the sensitive particles. This method is advantageous since it may develop a color image only by using plural exposure operations, i.e., three exposure operations corresponding to red, green and blue colors. However, such a method requires a recording medium comprising paper and a uniform coating of the sensitive particles disposed on the surface thereof, and therefore it cannot use plain paper as the recording medium. Further, even when a color image is intended to be formed only in a part of the recording medium surface, it is also necessary to subject the other portion of the surface to three exposure operations using sufficient light energy required for the decoloration so that it is converted into a white portion. Accordingly, the above-mentioned method requires a relatively long period of time in order to effect image formation.

SUMMARY OF THE INVENTION

A principal object of the present invention is to provide a color image-forming method which has solved the above-mentioned problems encountered in the prior art, and developer particles for developing an electrostatic latent image to be used in the above-mentioned color image-forming method.

More specific objects of the present invention are:

(1) to provide a color image-forming method capable of providing stable color images under any environmental condition, by reducing the number of developers and the number of repetitions of process having many variable factors (e.g., the number of repetitions of charging, latent image formation, transfer, development, etc.);

(2) to provide a color image-forming method capable of using a recording apparatus which can omit a large number of developing devices to be disposed therein, and can be miniaturized;

(3) to provide a color image-forming method capable of providing color images on plain paper at a high speed; and (4) to provide developer particles for developing an electrostatic image which may suitably be used in the above-mentioned color image forming methods (1), (2) and/or (3).

According to the present invention, there is provided a color image forming method, comprising:

providing a particulate developer comprising at least two species of sensitive particles which are capable of respectively absorbing lights having different wavelengths to be decolorized or faded;

developing an electrostatic latent image with the particulate developer to form an image comprising the developer; and exposing the developer image to light having a wavelength capable of selectively decolorizing at least one species of the sensitive particles.

The present invention further provides a particulate developer for developing electrostatic latent image comprising: at least two-species of sensitive particles which are capable of respectively absorbing lights having different wavelengths to be decolorized or faded.

In the color image forming method according to the present invention, an electrostatic latent image may be formed by electrophotography, electrostatic recording, etc., the latent image may be developed with developer particles in the same manner as in electrophotography, and then the plural species of sensitive particles constituting the developer particles are selectively exposed to light having a specific wavelength thereby to selectively decolorize the plural species of the sensitive particles. As a result, the colors of the developer particles may be changed to form a color image.

In the case of the formation of a multi-color image or pictorial image, it is preferred to conduct exposure operations using specific plural wavelengths sequentially or simultaneously, as described hereinafter. However, it is sufficient to conduct the developing step at one time, and therefore the above-mentioned problems in the prior art encountered in the case of plural developing operations may be solved.

Further, in the color image forming method according to the present invention, the developer particles may be selectively or imagewise attached to an electrophotographic photosensitive member or electrostatic image-bearing member on which an electrostatic image has been formed, and the resultant image comprising the thus attached developer particles may be converted into a color image, which may be then transferred to a recording medium (or transfer-receiving medium). Accordingly, the recording medium or image-supporting member may be arbitrarily selected from various media such as plain paper and film.

In the present invention, in a case where a color image is formed in a portion of the surface of the recording medium, the developer particles are present only in the portion of the surface on which the color image is to be formed, and therefore the decoloration of the non-image portion may be omitted, whereby the color image formation process may be conducted efficiently.

In the present invention, in a case where the developer particles are selectively decolorized to form a color image, since the position to be decolorized may be determined on the basis of the position of the developer particle image, the resultant positional precision may be enhanced as compared with in a case where the decoloration position is determined on the basis of the position of the end of paper. Further, in the present invention, when the electrostatic image is developed with developer particles, the amount of the developer particles to be attached to the photosensitive member may be regulated corresponding to an intended image density. Accordingly, in combination with a half-tone image treatment based on the decoloration, the half-tone image of an original may easily be reproduced.

In the present invention, in a case where the recording medium per se is one capable of bearing an electrostatic latent image, the step of transferring the developer particle image may be omitted.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Hereinbelow, a preferred embodiment of the present invention is specifically described with reference to FIG. 1. Table 1 appearing hereinafter shows some examples of the combination of a light source for image exposure and a light source for color image formation. Further, there is described hereinafter some examples of a sensitive agent having a sensitivity to light having a specific wavelength, which may be used for forming sensitive particles to be inclusively contained in the developer particles which respectively have sensitivities to lights with specific plural wavelengths.

Figure 1:
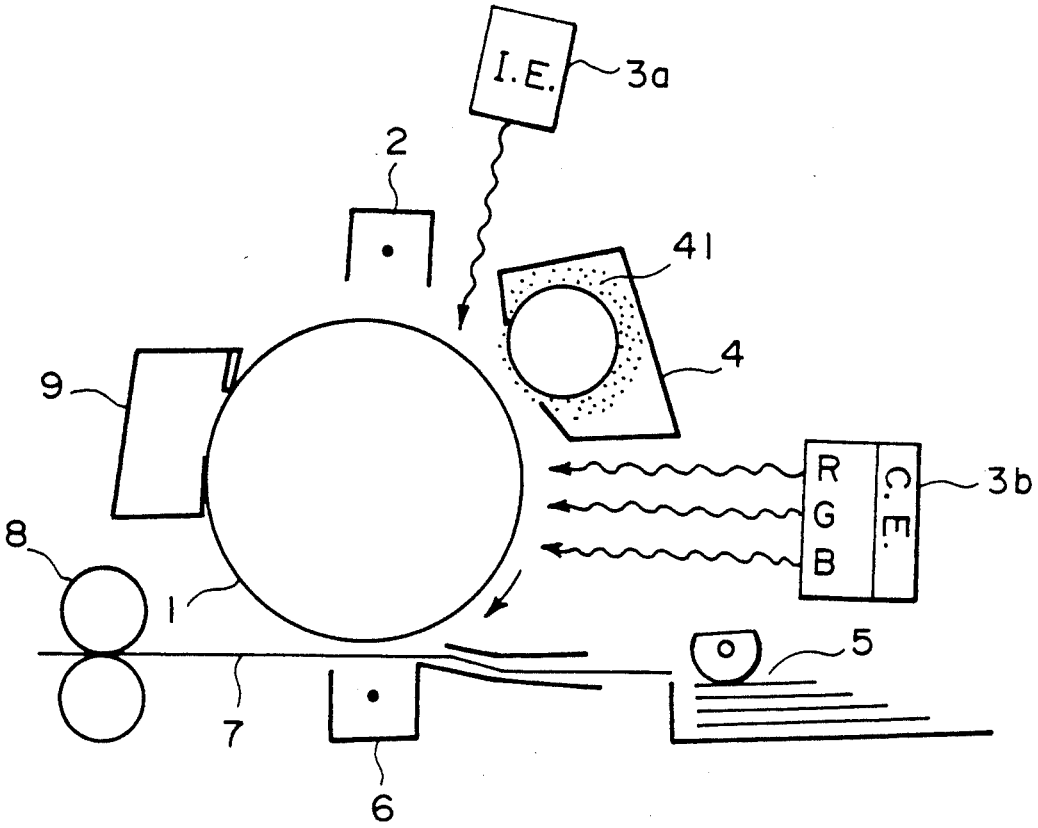
FIG. 1 is a schematic sectional view showing an embodiment of the apparatus for practicing the color image recording method according to the present invention.

FIG. 1 shows an embodiment of the image forming apparatus suitably used for practicing the image forming method according to the present invention. The apparatus shown in FIG. 1 comprises: a cylindrical electrophotographic photosensitive member 1 rotating in the direction of an arrow shown in FIG. 1; a charger 2 for charging the photosensitive member 1; an image exposure optical system unit 3*a* for forming an electrostatic latent image on the photosensitive member 1; a developing device 4 for developing the electrostatic latent image to form an image comprising developer particles 41; an optical system unit 3*b* for color image formation which is capable of exposing the above-mentioned developer particle image so that the color of the developer particle image is changed to provide a color image on the photosensitive member 1; a paper feed means 5 for feeding recording paper 7 to a transfer position at which a transfer means 6 is disposed opposite to the photosensitive member 1; the transfer means 6 for transferring the resultant color image comprising the developer particles from the photosensitive member 1 to the recording paper 7; a heat fixing device (e.g., a hot-roller fixing device) for fixing the color developer particle image to the recording paper 7 under heating; and a cleaning means 9 for removing residual developer particles from the photosensitive member 1. The above-mentioned charger 2, optical system unit 3*a* for image exposure, developing device 4, optical system unit for color image formation, transfer means 6 and cleaning means 9 are disposed in this order along the moving direction of the photosensitive member 1.

Figure 2:
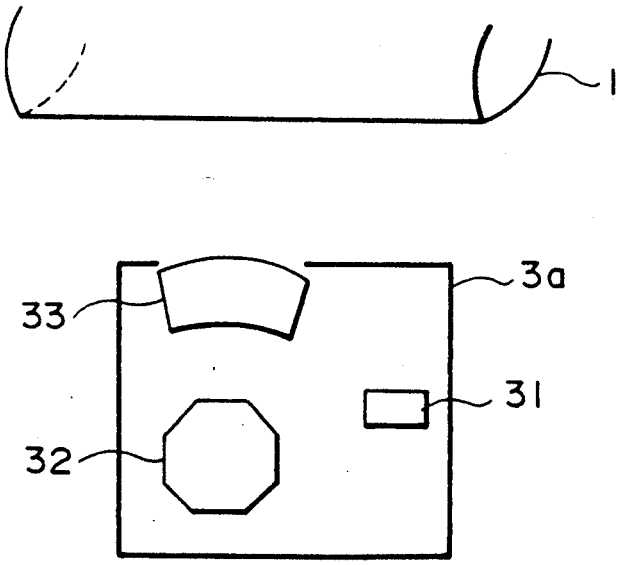
FIG. 2 is a schematic view showing an optical system unit to be used in the above-mentioned apparatus.

The image exposure optical system unit 3*a* may for example comprise a laser scanning optical system as shown in FIG. 2, which comprises an exposure light source 31 for providing light having one kind of wavelength; a polygon mirror 32, and a lens unit 33 such as f-$\theta$ lens.

Figure 3:
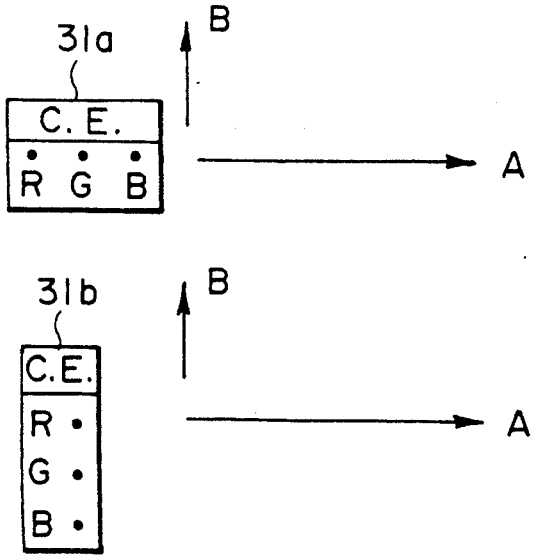
FIG. 3 is a schematic view for illustrating an embodiment of the light source for color image formation assembled in the above-mentioned optical system unit.

On the other hand, the optical system unit 3*b* for color image formation may for example comprise one having substantially the same structure as the laser optical system unit 3*a* shown in FIG. 2 which has a light source 31 capable of providing different wavelengths, e.g., those corresponding to R (red), G (green) and B (blue). In such a case, referring to FIG. 3, the exposure light source 31 may be either an exposure light source 31*a* comprising a light source (R) for providing red light, a light source (G) for providing green light, and a light source (B) for providing blue light, which are disposed along a main scanning direction A (i.e., a direction perpendicular to the moving direction of the photosensitive member 1); or an exposure light source 31*b* comprising a light source (R), a light source (G), and a light source (B), which are disposed along a subsidiary scanning direction B (i.e., a direction parallel to the moving direction of the photosensitive member 1). In order to obtain the light source R (red) by use of laser, an He-Ne laser may for example be used. In order to obtain the light source G (green) or B (blue), an Ar laser may for example be used.

The above-mentioned image exposure (I.E.) optical system unit 3*a* and color exposure (C.E.) optical system unit 3*b* should not be restricted to the laser optical system as shown in FIG. 2, but may also be one comprising a light source comprising: an LED (light-emitting diode); an LCS (liquid crystal shutter) equipped with a color filter; and/or an LD (laserdiode).

With respect to the combination of the light source usable in the optical system unit 3*a* (image exposure) and that usable in the optical system unit 3*b* (color exposure), the combinations (1) to (6) as shown in the following Table 1 may for example be used.

TABLE 1

| | (1) | (2) | (3) | (4) | (5) | (6) |
|---|---|---|---|---|---|---|
| Light source for 3a | LD | LD | LD | LED | LED | LCS |
| Light source for 3b | R, G, B | $LD_R$, $LD_G$, $LD_B$ | $LED_R$, $LED_G$, $LED_B$ | $LCS_R$, $LCS_G$, $LCS_B$ | $LED_R$, $LED_G$, $LED_B$ | $LCS_R$, $LCS_G$, $LCS_B$ | $LCS_R$, $LCS_G$, $LCS_B$ |
| | LD | LED | LCS | LED | LCS | LCS |

In the present invention, an electrostatic latent image formed by an image forming method such as electrophotography and electrostatic recording may be developed with developer particles each of which inclusively comprises at least two species of sensitive particles respectively having sensitivities to prescribed wavelengths; and then the resultant image comprising developer particles may be subjected to color exposure, whereby a color image is provided.

Hereinbelow, the present invention is described with reference to an embodiment wherein an electrophotographic process is utilized. In an embodiment utilizing electrostatic recording, an electrostatic recording member (not shown) may be used instead of the electrophotographic photosensitive member 1, and an electrostatic recording head (not shown) may be used instead of the image exposure optical system unit 3*a*. In such an embodiment, the charger 2 may preferably be one having a function of retaining the electrostatic recording member at a predetermined potential. However, the charger 2 may be omitted in a case where the electrostatic recording member is not used repeatedly.

Referring to FIG. 1, in a preferred embodiment of the present invention, the surface of the electrophotographic photosensitive member 1 is charged by means of the charger 2 as to provide a predetermined potential, and then the photosensitive member surface is imagewise exposed by means of the image exposure optical system unit 3*a* (i.e., a laser scanning optical system unit in this embodiment), whereby the potential of the surface of the electrophotographic photosensitive member 1 is selectively decreased to provide a latent image. Thereafter, developer particles 41 contained in the developing device 4 which may preferably be charged so as to have the same charging polarity as that of the photosensitive member 1 are attached to the photosensitive member 1 surface, thereby to develop the latent image.

Figure 5:
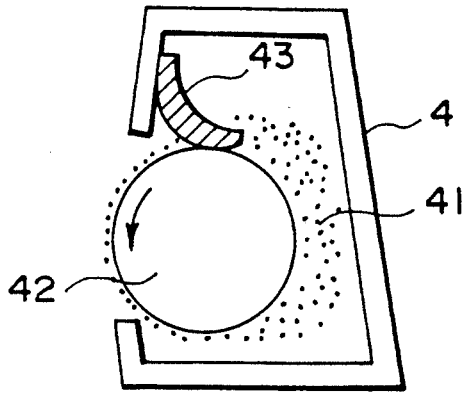
FIG. 5 is a schematic sectional view showing an embodiment of the developing device using the above-mentioned developer particles.

Referring to FIG. 5, the developing device 4 used herein may be one comprising a developing roller 42 rotating in the direction of an arrow shown in FIG. 5, and an elastic (or elastomeric) coating blade 43 comprising, e.g., a rubber plate preferably having a thickness of 2–4 mm. The coating blade 43 may preferably be caused to contact the developing roller 42 under pressure so that the direction of the coating blade 43 is counter to the rotating direction of the developing roller 42, and a portion of the blade 43 other than the edge portion thereof contacts the developing roller 42. The surface of the developing roller 42 may preferably be roughened so as to provide a roughness which is equal to or smaller than the number-average particle size of the developer particles 41. Along with the rotation of the developing roller 42 shown by the arrow in FIG. 5, a layer of the developer particles 41 having a thickness of preferably 120±60 microns (e.g., about 120 microns) may be formed on the developing roller 42.

In order to attach to a portion of the photosensitive member 1 having a decreased potential the developer particles 41 having the same charging polarity, it is preferred to apply a developing bias voltage between the developing roller 42 and the electrophotographic photosensitive member 1. The developing bias voltage used herein may comprise (1) a DC voltage alone, or (2) a superposition obtained by superposing an AC voltage on a DC voltage. In both of the above-mentioned cases (1) and (2), the DC voltage may preferably be set so that the polarity of the photosensitive member side is the same as that of the charging polarity of the photosensitive member. For example, in the case of DC voltage application, it is preferred to apply a voltage which is almost equal to or lower than the charging voltage of the photosensitive member 1. In the case of alternating voltage application, it is preferred to apply a superposition obtained by superposing an AC voltage having a frequency of about 400 Hz to 3 KHz and a Vpp (peak-to-peak voltage) of about 800 Vpp to 2 KVpp on the above-mentioned DC voltage.

Then, the resultant developed image comprising the developer particles is subjected to exposure by means of the color exposure optical system unit 3*b* to selectively change the color of the developer particle image, whereby a color image is obtained.

In order to effect the exposure so that the exposure position due to the color exposure optical system unit 3*b* does not substantially deviate from the target of the developer particle image, it is preferred to precisely effect the exposure due to the color exposure optical unit 3*b* in synchronism with the exposure due to the image exposure optical unit 3*a*. Further, it is possible to determine the timing of the exposure due to the color exposure optical unit 3*b* by detecting the developer particle image, which has been obtained by developing the electrostatic latent image based on the image exposure optical unit 3*a* with the developing device 4, by means of a sensor such as CCD (charge coupled device).

Figure 4:
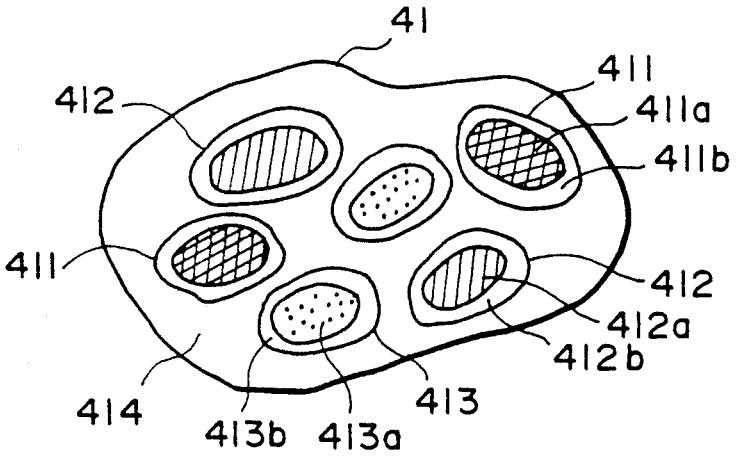
FIG. 4 is a schematic sectional view for illustrating an embodiment of the developer particle inclusively comprising plural species of sensitive particles respectively having sensitivities to lights with plural wavelengths.

FIG. 4 schematically shows a developer particle 41 inclusively comprising plural species of sensitive particles 411, 412 and 413 respectively having sensitivities to lights having plural wavelengths. The developer particle 41 may preferably have a number-average particle size of 3–30 microns, more preferably 4–15 microns.

Referring to FIG. 4, the developer particle 41 may preferably comprise a binder 414 and at least two species of sensitive particles. The sensitive particle 411 may preferably comprise a semiconductor particle 411*a* and a layer 411*b* comprising at least a spiropyran metal complex. The semiconductor particle 411*a*, 412*a* or 413*a* may comprise a semiconductor such as zinc oxide (ZnO), titanium oxide ($TiO_2$), and polyvinyl carbazole (PVk). The layer 411*b*, 412*b* or 413*b* may comprise at least a spiropyran metal complex. The spiropyran complexes constituting the layers 411*b*, 412*b* and 413*b* respectively have sensitivities to different wavelengths of light. The layer 411*b*, 412*b* or 413*b* may be fixed to the surface of the semiconductor particle 411*a*, 412*a* or 413*a*, and may preferably comprise the spiropyran metal complex, or a hydrophilic resin and the spiropyran complex. The binder 414 inclusively contains the above-mentioned sensitive particles 411, 412 and 413 respectively having sensitivities to different wavelengths so that they constitute the developer particle 41. The binder may preferably be used in an amount of 10 wt. parts or more with respect to 100 wt. parts of the sensitive particles.

The hydrophilic resin may preferably be a resin soluble in water or alcohol such as polyvinyl butyral, polyvinyl formal, polyvinyl alcohol, polyvinyl pyrrolidone, ethyl cellulose, and methyl cellulose.

Specific examples of a spiropyran metal complex (photosensitive agent) having a sensitivity to green light, a spiropyran metal complex (photosensitive agent) having a sensitivity to red light, and a spiropyran metal complex (photosensitive agent) having a sensitivity to blue light may include the following compounds:

(Photosensitive agent sensitive to green light)

cobalt chloride-1,3-dimethyl-3-isopropyl-6′-nitro-spiro complex, zinc naphthenate-1,3,3-trimethyl-7′-nitro-spiro complex, lead naphthenate-1,3,3-trimethyl-5-chloro-5′-nitro-8′-methoxy-spiro complex, and cobalt chloride-1,3,3-trimethyl-indole nonaphtospyran complex.

(Photosensitive agent sensitive to blue light)

titanium chloride-1,3,3-trimethyl-nitro-spiro complex, zinc chloride-3,3′-dimethyl-6′-nitro-spiro complex, and antimony chloride-3-methyl-6-nitro-spiro complex.

(Photosensitive agent sensitive to red light)

barium naphthenate-1,3,3-trimethyl-nitro-spiro complex, barium naphthenate-1,3,3-trimethyl-indolino-benzopyrilo-spiran complex, and mercurous chloride-1-phenyl-3,3-dimethyl-6′-nitro-8-methoxy-spiro complex.

When the above-mentioned photosensitive agent is fixed on the surface of the semiconductor particle 411*a*, 412*a* or 413*a*, and exposed to light having a sensitive wavelength, it is considered that the electrons produced by the irradiation effectively function and successively cause a chain reaction. As a result, the original color of the sensitive particles 411, 412 and 413 (e.g., cyan, magenta and yellow) may selectively be decolorized or faded, whereby a desired color tone appears in the developer particle 41 (further, in the developer particle image). Needless to say, in a case wherein a multi-color image recording is intended, the original color of the sensitive particles 411, 412 and 413 should not be restricted to cyan, magenta and yellow.

In the present invention, in an embodiment utilizing an electrostatic recording method, etc., an electrostatic latent image may be formed on an electrostatic recording paper, etc., the latent image may be developed with developer particles, the resultant developer particle image may be subjected to color exposure, and then the developer particle image may be fixed to the paper by means of a hot-roller fixing device, etc. When a heat-crosslinking polymer as described hereinafter is used, the polymer constituting the developer particle image may be thermally crosslinked so that the color image is firmly fixed to the paper.

As described hereinabove, the present invention may provide the following advantages:

(1) There is provided a color image-forming method which is capable of providing stable color images under any environmental condition, by reducing the number of developers and the number of repetitions of processes having many variable factors (e.g., the number of repetitions of charging, latent image formation, transfer, development, etc.).

(2) There is provided a color image-forming wherein the image memory required for image formation is reduced, e.g., by omitting a page memory or a large number of buffer memories.

(3) There is provided a color image-forming method capable of using a recording apparatus which can omit a large number of developing devices to be disposed therein and can be miniaturized.

(4) There is provided a color image-forming method which is capable of providing color images on plain paper, and capable of forming a color image without decolorizing a non-image portion.

The present invention is described in more detail with reference to Examples.

EXAMPLE 1

(Preparation of sensitive particles)

5 wt. parts of spiropyran-zinc chloride was dissolved in a small amount of methanol thereby to provide a spiropyran metal complex wherein the metal atom was bonded to the ring-opened spiropyran (zinc chloride-3,3′-dimethyl-6′-nitro-spiro complex). Then, to the resultant liquid, 18 wt. parts of a polyvinyl alcohol resin as a hydrophilic resin was dissolved.

Thereafter, 100 wt. parts of titanium oxide powder (as semiconductor particles) was dissolved in the resultant liquid mixture and was sufficiently stirred by means of a ball mill, and a sufficient amount of petroleum hydrocarbon dispersion medium was added to the resultant mixture, and was again stirred by means of the ball mill. In such a manner, a layer comprising the spiropyran metal complex and the hydrophilic resin was formed on the surfaces of the titanium oxide particles (semiconductor particles).

The thus obtained dispersion was subjected to filtration by using a paper filter and then dried to provide titanium oxide particles (semiconductor particles) having a number-average particle size of about 1 micron and having surfaces to which the spiropyran metal complex layer had been fixed. The thus obtained titanium oxide particles were sensitive particles having a sensitivity to blue light.

The above-mentioned procedure was repeated except that titanium oxide particles were coated with a polyvinyl alcohol resin (hydrophilic resin) and a photosensitive agent having a sensitivity to green light (cobalt chloride 1,3-dimethyl-3-isopropyl-6'-nitro-spiro complex).

Further, the above-mentioned procedure was repeated except that titanium oxide particles were coated with a polyvinyl alcohol resin (hydrophilic resin) and a photosensitive agent having a sensitivity to red light (barium naphthenate 1,3,3-trimethyl-nitro-spiro complex).

(Preparation of developer particles)

The above-mentioned three species of sensitive particles were mixed in a solution of a crosslinking polymer (inclusive of a polymerization initiator) which was insoluble in water or alcohol, and stirred to provide an emulsion. Since the photosensitive layer formed on the surfaces of the semiconductor particles was hydrophilic, the photosensitive layer was not dissolved but was stably retained in the solution of the crosslinking polymer.

More specifically, the above-mentioned emulsion had the following composition:

| | |
|---|---|
| Polyvinyl chloride | 2.5 g |
| Cyclohexane | 32.5 g |
| Toluene | 5.0 g |
| Heat-crosslinking unsaturated polyester | 5.0 g |
| Benzoyl peroxide | 0.1 g |
| Tributyl phosphate | 1.5 g |
| Particles sensitive to green light | 12.0 g |
| Particles sensitive to blue light | 12.0 g |
| Particles sensitive to red light | 12.0 g |

The above-mentioned emulsion was dried and pulverized to obtain a developer comprising developer particles having a number-average particle size of about 12 microns.

In order to improve the fluidity of the developer particles and to stably charge them, 0.5 wt. % (based on the weight of the developer) of silica fine powder was added to the developer particles. By using an image forming apparatus as shown in FIG. 1, an electrostatic latent image formed on a photosensitive member 1 corresponding to an original was developed with the thus obtained developer particles and the resultant developer particle image was exposed to light by means of a light source 3*b* for color exposure, thereby to provide a color image on the photosensitive member 1 which was clear and was faithful to the original. Then, the resultant image was transferred from the photosensitive member 1 to paper 7 and fixed thereto by means of a hot-roller fixing device 8. As a result, the heat-crosslinking polymer binder 414 (as shown in FIG. 4) was crosslinked and the color image was fixed to the paper 7.

In this instance, a portion of the developer particle image not supplied with color exposure provided a black image.

EXAMPLE 2

A photosensitive emulsion was prepared in the same manner as in Example 1, except for using three species of photosensitive powders having a number-average particle size of below about 1 micron which had been obtained by coating the surfaces of semiconductor particles (titanium oxide particles) with the respective spiropyran metal complexes by simple adsorption without using a hydrophilic resin. More specifically, each spiropyran metal complex was adsorbed on the semiconductor particles by dipping the semiconductor particles into a solution of the spiropyran metal complex and then drying the particles.

The thus obtained emulsion was dried and pulverized in the same manner as in Example 1, thereby to obtain a developer comprising developer particles having a number-average particle size of about 10 microns.

The above-mentioned developer was mixed with silica fine powder and subjected to color image formation (inclusive of color exposure step) in the same manner as in Example 1. As a result, a clear color recorded image was obtained.

In this instance, however, the surfaces of the semiconductor particles were coated with a thinner layer of the spiropyran metal complex without using a hydrophilic polymer. Accordingly, an image having the same quality as that in Example 1 was obtained by increasing the exposure light quantity for color exposure as compared with that in Example 1 so that the former became two times or more larger than the latter.

What is claimed is:

1. A color image forming method, comprising:

providing a particulate developer comprising at least two species of sensitive particles which are capable of respectively absorbing lights having different wavelengths to be decolorized or faded;

developing an electrostatic latent image with the particulate developer to form an image comprising the developer; and exposing the developer image to light having a wavelength capable of selectively decolorizing at least one species of the sensitive particles.

2. A method according to claim 1, wherein the electrostatic latent image is formed by charging an electrophotographic photosensitive member and imagewise exposing the photosensitive member.

3. A method according to claim 2, wherein the photosensitive member is imagewise exposed by means of an optical scanning system using a laser beam.

4. A method according to claim 1, wherein the sensitive particles are selectively decolorized by three kinds of lights respectively having wavelengths corresponding to red, green and blue.

5. A method according to claim 1, wherein the timing of the exposure of the light for selectively decolorizing the sensitive particle is determined by detecting the developer image by use of a sensor.

6. A method according to claim 1, wherein the sensitive particle comprises a semiconductor particle, and a spiropyran metal complex disposed on the surface of the semiconductor particle.

7. A particulate developer for developing an electrostatic latent image, comprising at least two species of sensitive particles which are capable of respectively absorbing lights having different wavelengths to be decolorized or faded.

8. A developer according to claim 7, wherein the sensitive particle comprises a semiconductor particle, and a spiropyran metal complex disposed on the surface of the semiconductor particle.

9. A developer according to claim 8, wherein the semiconductor particle comprises a material selected from the group consisting of zinc oxide and titanium oxide.

10. A developer according to claim 8, wherein the spiropyran metal complex is attached to the surface of the semiconductor particle together with a hydrophilic resin.

11. A developer according to claim 7, wherein the at least two species of the sensitive particles respectively comprise spiropyran metal complexes having sensitivities to green light, red light and blue light.

12. A particulate developer for developing an electrostatic latent image comprising:

(a) at least two species of sensitive particles which are capable of respectively absorbing light having different wavelengths to be decolorized or faded; and (b) silica fine powder to enhance fluidity and as a charge control agent.

* * * * *